US009547281B2

(12) United States Patent
Rubin et al.

(10) Patent No.: US 9,547,281 B2
(45) Date of Patent: Jan. 17, 2017

(54) ELECTRONIC TIMER

(71) Applicants: Kim Rubin, Menlo Park, CA (US); William J. Sell, Petaluma, CA (US); Ken C. Holt, Cazadero, CA (US)

(72) Inventors: Kim Rubin, Menlo Park, CA (US); William J. Sell, Petaluma, CA (US); Ken C. Holt, Cazadero, CA (US)

( * ) Notice: Subject to any disclaimer, the term of this patent is extended or adjusted under 35 U.S.C. 154(b) by 1 day.

(21) Appl. No.: 14/589,525

(22) Filed: Jan. 5, 2015

(65) Prior Publication Data

US 2016/0195854 A1 Jul. 7, 2016

(51) Int. Cl.

| | |
|---|---|
| ***G04F 1/00*** | (2006.01) |
| ***G04F 1/04*** | (2006.01) |
| ***G04G 9/02*** | (2006.01) |

(52) U.S. Cl.

CPC ..... *G04F 1/005* (2013.01); *G04F 1/00* (2013.01); *G04F 1/04* (2013.01); *G04G 9/02* (2013.01)

(58) Field of Classification Search

CPC ..... G04F 1/00; G04F 1/005; G04F 1/04; G04G 9/02

USPC ..... 368/107–109; 463/22; D10/1, 21

See application file for complete search history.

(56) References Cited

U.S. PATENT DOCUMENTS 3,533,229 A * 10/1970 Liljequist ..... G04F 1/08 368/93
4,158,921 A * 6/1979 Stolpen ..... A63H 33/04 273/146
4,451,158 A * 5/1984 Selwyn ..... G04G 13/00 368/107
4,720,820 A * 1/1988 Siefert ..... G04B 45/0053 368/223
4,888,748 A * 12/1989 Lagasse ..... G04B 37/0066 368/107

(Continued)

FOREIGN PATENT DOCUMENTS

JP 58096271 A * 6/1983

OTHER PUBLICATIONS

Cube Timer, Sep. 27, 2014, full document, Retrieved from mogobox.com on Nov. 30, 2015.*

(Continued)

*Primary Examiner* — Amy Cohen Johnson
*Assistant Examiner* — Daniel Wicklund
(74) *Attorney, Agent, or Firm* — Kim Rubin, Patent Agent

(57) ABSTRACT

An electronic interval timer in a dodecahedron case is described. The timer is set by turning uppermost one of 11 faces; and reset by turning uppermost the 12$^{th}$ face. In one embodiment, the timer is free of buttons, knobs, springs, time displays, electronic visual indicators and openings in the case. Time interval completion is announced via audible tones or speech. An aggregate time interval may be set equal to the sum of legends on more than one face. The timer detects carrying such that a running time interval is not modified. The timer may be programmed via a sequence of uppermost sides. Modes may be selected via shaking or tapping. Time remaining may be announced, an interval cleared, or an interval restarted responsive to detected motion. Other polyhedral shapes may be used. Claims include a method of setting a time interval; and specific ordering of face legends.

1 Claim, 11 Drawing Sheets

(56) References Cited

U.S. PATENT DOCUMENTS

| | | | | |
|---|---|---|---|---|
| 5,339,295 | A * | 8/1994 | Hiromori | G04F 3/027 368/108 |
| 5,349,573 | A * | 9/1994 | Hiromori | G04F 3/027 368/108 |
| 5,990,782 | A * | 11/1999 | Lee | A61J 7/0481 340/309.4 |
| 6,271,453 | B1 * | 8/2001 | Hacker | G09B 15/003 434/171 |
| 6,904,001 | B1 * | 6/2005 | Rast | A44B 11/008 368/107 |
| 2003/0090961 | A1 * | 5/2003 | Blonder | G04G 9/08 368/82 |
| 2003/0148700 | A1 * | 8/2003 | Arlinsky | A63H 33/04 446/91 |
| 2003/0179653 | A1 * | 9/2003 | McLemore | A47J 36/32 368/10 |
| 2005/0164778 | A1 * | 7/2005 | Cooney | A63F 9/0468 463/22 |
| 2006/0093995 | A1 * | 5/2006 | Brown | G09B 5/06 434/171 |
| 2007/0008825 | A1 * | 1/2007 | Tang | G04B 25/04 368/73 |
| 2009/0210101 | A1 * | 8/2009 | Hawkins | A63F 9/04 700/297 |
| 2010/0177598 | A1 * | 7/2010 | Zhang | G04G 13/026 368/10 |
| 2011/0110198 | A1 * | 5/2011 | Bulsink | A63F 11/00 368/96 |
| 2011/0300921 | A1 * | 12/2011 | Peterson | A63F 9/0415 463/22 |
| 2014/0253325 | A1 * | 9/2014 | Ky | G08B 21/0415 340/539.13 |
| 2015/0227245 | A1 * | 8/2015 | Inagaki | G06F 3/0412 345/173 |

OTHER PUBLICATIONS

Nontransitive Dice, Nov. 4, 2014 Wikipedia, full document, retrieved on Jun. 30, 2016 from <http://en.wikipedia.org/wiki/Nontransitive_dice>.*

Nagoya, English Translation of JP58096271, originally published Jun. 8, 1983, full document.*

Datexx The Miracle Cube Timer; www.amazon.com•, retrieved Jan. 6, 2016; Mfg: Datexx.

* cited by examiner

ELECTRONIC TIMER

FIELD OF THE INVENTION

The field of this invention is timers. More specifically, the field is convenience timers, sometimes referred to as kitchen timers. They may also be used to time play, classes, work, or other activities.

BACKGROUND OF THE INVENTION

Timers that provide an alert or signal at the expiration of a set time are as old as the hourglass.

Later, mechanical timers typically comprised a spring, a governor or balance wheel, a knob for winding the spring, a pointer, and a dial with markings. The user would turn the knob to both set a desired time and to wind the spring. The timer ran at a (hopefully) fixed speed, calibrated to the dial. When the set time was up, the spring would also power a bell, announcing the completion of the set interval.

Now, electronic timers are prevalent. A common format comprises a keyboard, typically with the digits 0 through 9 plus a few function keys, such as start, pause, and reset. These timers usually include a display, such as an LCD, initially showing the time interval being set, and then the time remaining. An audible alarm announcements completion, often continuous until the alarm is manually cleared.

Such electronic timers are cheaper and more reliable that the mechanical timers they replaced. However, they suffer from many disadvantages. The buttons are usually small—hard to see and hard for many people to operate. Similarly, the displays are often small and hard to see. Such timers are effectively useless in the dark, and hard to use in dim light, or for people who are not wearing their glasses. They are very difficult for people to use who have limited use of their fingers or hands, or have limited eyesight.

In addition, electronic timers are neither fast to set, nor intuitive. While a traditional mechanical timer required no more than a twist of the knob, electronic timers require a specific sequence of buttons to be pushed. Such multiple actions require accurate sight, dexterity and thinking.

In addition, electronic timers, typically, have other disadvantages. For example, they use batteries that must be replaced, they are not waterproof, and they break easily. Although these weaknesses could be overcome by engineering, design and money, the inherent elements of the current art of electronic timers, such as keyboards and displays, make such ruggedization challenging, and, in practice, is not done. Multiple button sequences and the need for light are endemic requirements for current electronic timers.

Devices such as smart phones include timers as applications. Although the user interfaces for these are dramatic improvements over electronic timers, such as the use of voice commands to set the timer, they require an expensive, fragile and theft-prone platform on which to run. They are not suitable for dedicated use, nor appropriate for rugged applications. Such expensive devices are rarely used as kitchen timers because of the dangers in the kitchen of spills and dropping. Voice programmed apps do not respond to all languages, nor to all speakers.

Both electronic timers and smart-phone timing applications may provide illuminated displays. However, the power usage of such displays then requires either frequent battery changes or frequent charging—both of which are a serious inconvenience and often result in a non-operational timer when needed.

In addition, all such timers discussed above rarely permit more than one time interval to be set concurrently. Nor do such timers announce the length of a set time interval at the completion of the interval.

SUMMARY OF THE INVENTION

The current invention solves the discussed weakness of the prior art. It may be the easiest to use settable timer ever invented. Only one hand is required for setting. The timer works for users who speak any language, unlike voice-programmed timers. A basic embodiment consists of a 12-sided polyhedron shape. The faces of the polyhedron are printed or embossed with an interval length legend in large, high-contrast digits. To set the timer, one simply rotates the timer until the desired time interval is face up. No other action is required. There are no buttons, knobs, or displays.

When the set time interval expires, the timer provides an audible alert.

One face of the timer indicates "OFF." This face is placed up to prematurely terminate a set interval or to place the timer into a known state. The legend on the OFF face may be, "0."

In one embodiment, a set time interval may be changed or restarted by simply again rotating the timer. In another embodiment, rotation to a new face while an interval is running causes a second time interval to be started, running concurrently. In yet another embodiment, rotation to multiple faces in a sequence creates a time interval equal to the sum of the legends on the multiple faces. These embodiments may be combined, using, for example, the elapsed time between rotations to select the operational mode.

In one exemplary implementation, 11 available fixed times are: 1, 2, 3, 5, 7, 10, 15, 20, 30, 45 and 60 minutes. Another implementation comprises: 1, 2, 3, 5, 10, 15, 20, 30, 40, 50, and 60 minute times on face legends.

DETAILED DESCRIPTION OF THE INVENTION

Figure 1:
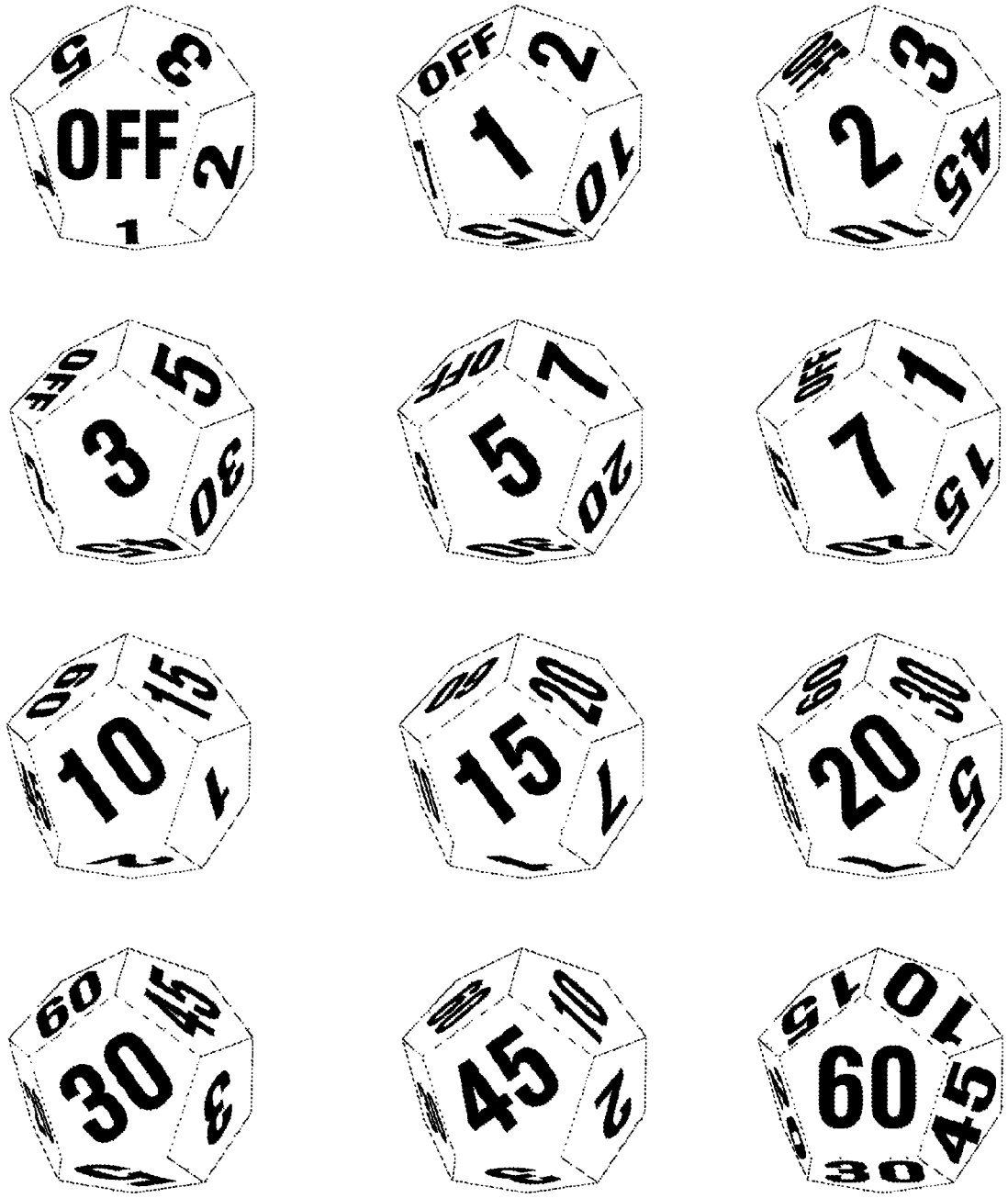
FIG. 1 shows 12 views of 12 sides of an embodiment of a dodecahedron timer.

The basic operation of the timer, in various embodiments is described above in SUMMARY OF THE INVENTION.

There are many choices of implementation options, as those trained in the art know. There are many choices of operational states and state machines, as those trained in the art know.

There are many choices of audio message announcements, either tones, speech, or special audio effects, as well as visual and haptic announcements, as those trained in the art know.

High contrast, large face legends permit the timer to be easily read in dim light, or by people with compromised vision. The use of embossed digits, or braille, permits easy use by people with poor or no vision.

Some embodiments provide a set of audible indications that are responsive to the length of a time interval, an operating mode, or setting activity. An optional repetitive tick provides confidence a time interval is running.

Some embodiments permit the legends on the faces to be altered by users, for example, by adhesive stickers. The stickers may provide symbols for particular times, such as egg to show a time interval for cooking an egg. A symbol may indicate that a class, lesson, meeting or session is ending.

Some embodiments provide for wireless communication, which may be unidirectional or bi-directional.

In one embodiment, a user may create or choose a set of times he or she wishes the timer to support. The legends on the faces may be manually changed to match wirelessly set times. Although this embodiment is programmable to user desired configurations, the timer remains overwhelmingly simple and reliable to use.

In another embodiment, a user may wirelessly download tones or announcements. In this way, time intervals may be announced appropriately for that user, such as "Your egg is cooked," "Class is over," or "Time for bed."

In one embodiment, the timer is waterproof and sanitizable. It may be washed by hand or in the dishwasher, or, in some embodiments, autoclaved. These features allow the timer to be used in medical environments, schools and outdoors without fear of either contamination that damages the timer or the transmission of germs. Because there are no buttons, knobs or electronic displays, the timer is easily sealed and is cleanable without the risk of small crevices harboring bacteria or allowing the entry of water or germs. Prior art, with the possible exception of the hourglass, does not have these attributes.

In one embodiment, there is no access to an internal, permanently sealed battery. Because there are no electronic displays, ten-year battery life is easily achievable.

In one embodiment, the timer case may be transparent or translucent, or have such portions, allowing an interior light to be used to illuminate the legends on the faces, locate the timer at night, or pulse to show activity, or flash to indicate time completion.

The timer may be wirelessly chargeable, incorporating an electromagnetic power receiver or an optical power receiver. The optical power receiver may be responsive to infrared (IR) light, permitting all faces to be opaque to visible light.

In addition, a transparent or translucent case may permit an internal sealed battery to be charged using solar or light energy.

In some embodiments, the timer is exceptionally rugged. A polyhedron shape is easily manufactured at reasonable cost (compared to a smart phone) and adapted to withstand high stress. With no buttons, knobs, springs, displays or openings, the timer may easily be manufactured to withstand substantial abuse, such as being dropped repeatedly or very rough play by children, or for use in a classroom, or prison, or for use in health care.

In some embodiments, the polyhedron shape may have rounded vertices and edges, permitting use by children or otherwise in environments where a traditional timer might cause harm, for example, if one child threw it at another child, or in a prison.

In a simple embodiment, the user simply sets a desired time by rotating the timer until the desired time is shown on the upper face. When that time expires, the timer provides an alert, which may be any combination of one or more audible, visual, or tactile (such as vibratory) signals.

In some embodiments the timer may be carried during a running time interval without altering the running time interval.

In some embodiments the timer has a "transport" mode during which the timer operates at lower power and is silent. This mode may be exited automatically at the cessation of movement. In some embodiment the timer has a "dishwasher" mode that causes lower power operation and silence operating during transport. This mode may be exited automatically at the cessation of movement. This mode may or may not be the same mode as "transport" mode.

In some embodiments the timer has a "factory" mode during which the timer operates at lower power and is silent until this mode is exited by a specific action, or set of actions, or sequence of actions.

In some embodiments the timer has a "retail" or "demo" mode that changes the available time intervals and audio alerts, or both, to permit demonstration.

In some embodiments the timer has a "retail" or "demo" mode that changes the available time intervals and audio alerts, or both, to permit demonstration.

In some embodiments a predetermined sequence of uppermost faces causes a mode change.

In some embodiments specific audio announcements are made by the timer when entering or exiting modes.

Some embodiments comprise operating modes comprising announcements in mode-determined languages.

More complex embodiments include an indication when the timer is set; or of the set time, or that the time is running, or that a running time has been changed or restarted; or that the timer has been moved; or the timer has been programmed, or the timer has an error; or the timer battery is low; or other functions, modes or features, or any combination of these. Audible outputs may be sounds, musical tones, speech in any or variable languages, or combinations thereof. Audible outputs may be selected, programmed, or downloaded by end-users, or by a manufacturer or distributor in advance of delivery to and end-customer.

Various embodiments are ideal for people who are blind or sight impaired. Various embodiments are ideal for people who are deaf or hearing impaired. Various embodiments are ideal for people who have limited finger or hand dexterity.

A set of views of one embodiment is provided in 12 views in FIG. 1. This Figure shows overhead views. Other figures typically show perspective views. Numerous times interval values other than those shown in this exemplary embodiment may be used. These times may be units of minutes, or other units of time. Legends need not be Arabic numbers. For example, Hebrew numbers or Chinese numbers may be used, or times may be spelled out in a language.

In one embodiment, the shortest five times are placed in the top hemisphere (defined by OFF up), with the longest six times placed in the bottom hemisphere. In one embodiment, the longest time, such as 60 minutes, in placed on the face opposite the OFF face. In one embodiment, the legend, color, feel, or combination of these attributes of the OFF face are distinct from the other faces in order to facilitate ease of identifying the OFF face. The word, "OFF" may be in any language, or may be a symbol such as an international symbol for off, or the digit zero.

In this embodiment, shown in FIG. 1, the five faces surrounding and adjacent to the OFF face read left-to-right, for increasing times, as one holds the timer with the OFF face generally up. In this Figure, note the shown times are, in sequence: 1, 2, 3, 5, and 7. Note also that the orientation of the legends for these five faces are such that they read normally (with respect to orientation and angle), with the OFF face uppermost. These arrangements are valuable in aiding visibility and ease of use, including intuitively locating a desired face. This arrangement is most visible looking at the upper left view in FIG. 1.

Note that in this embodiment the longest times are on the lower hemisphere. The "bottom" of the timer has the longest time, here, 60. Note that when this face is uppermost (that is, the timer is turned "upside down" from the normal, OFF position) that the five next longest times (here: 10, 15, 20, 30, 45) are arranged such that they read normally (with respect to orientation and angle), and increase in sequence, left-to-right, for 10, 15, 20, 30 and 45. This arrangement is most visible looking at the lower right view in FIG. 1. These arrangements of the six largest times are valuable in aiding visibility and ease of use, including intuitively locating a desired face. Such arrangements, independent of specific times, are claimed explicitly as embodiments of the invention.

There are many alternative time sets. Once such set is: 1, 2, 3, 5, 10, 15, 20, 30, 40, 50, and 60. Another such set is: 1, 2, 3, 5, 10, 15, 30, 45, 60, 120, 180 minutes. Time units may be minutes, seconds, hours, or other units. Such units may or may not be included in legends, and may be mixed. For example, the legends for 60, 120 and 180 minute may be, "1 hour," "2 hours," and "3 hours." Timers used for demonstration may have shorter times. For example, times normally in minutes may become times in seconds for sales or demonstration purposes. In some embodiments the set of available times may be mode dependent.

Figure 2:
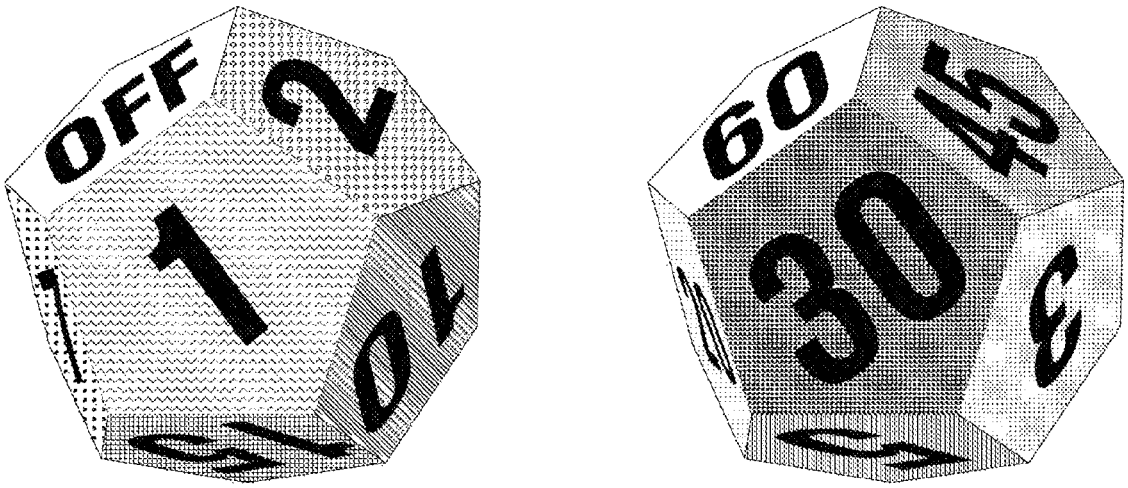
FIG. 2 shows two views showing one embodiment of coloration.

FIG. 2 shows possible coloration of sides. In one embodiment, each face background is a unique color. Another embodiment uses images on sides or for legends. For example an image of an egg (in the sell, or cooked) may be used in place or "3 minutes," or another time. Similarly, a plate of spaghetti might be used in place of "10 minutes." In FIG. 2, different colors are indicated by different patterns. In one embodiment, the faces in the upper hemisphere have light backgrounds, such as pastels, with dark legends; while the faces in the lower hemisphere have dark backgrounds with light legends. This embodiment is not shown in FIG. 2. Table 1, below, shows one embodiment of colored faces with named colors. Note, in particular, the use of dark legends on light or pastel colors for the low-numbered times, and white legends on dark or fully saturated color for high-numbered times. Note also, the use of only black and white colors for the "top" and "bottom" of the timer. These arrangements are specifically claimed embodiments. In yet another embodiment, increasing times are denoted by the use of sequential rainbow colors.

TABLE 1

| Exemplary Color Embodiment | |
|---|---|
| Face | Colors |
| OFF | Black type on White background |
| 1 | Black type on Yellow or Light Yellow background |

TABLE 1-continued

| Exemplary Color Embodiment | |
|---|---|
| Face | Colors |
| 2 | Black type on PaleGreen or aquamarine background |
| 3 | Black type on LightBlue or SkyBlue background |
| 5 | Black type on Pink or LightPink background |
| 7 | Black type on PeachPuff or NavahoWhite background |
| 10 | White type on Brown or SaddleBrown background |
| 15 | White type on Crimson background |
| 20 | White type on BlueViolet or DarkViolet background |
| 30 | White type on Indigo background |
| 45 | White type on Green or DarkGreen background |
| 60 | White type on Black background |

Figure 3A:
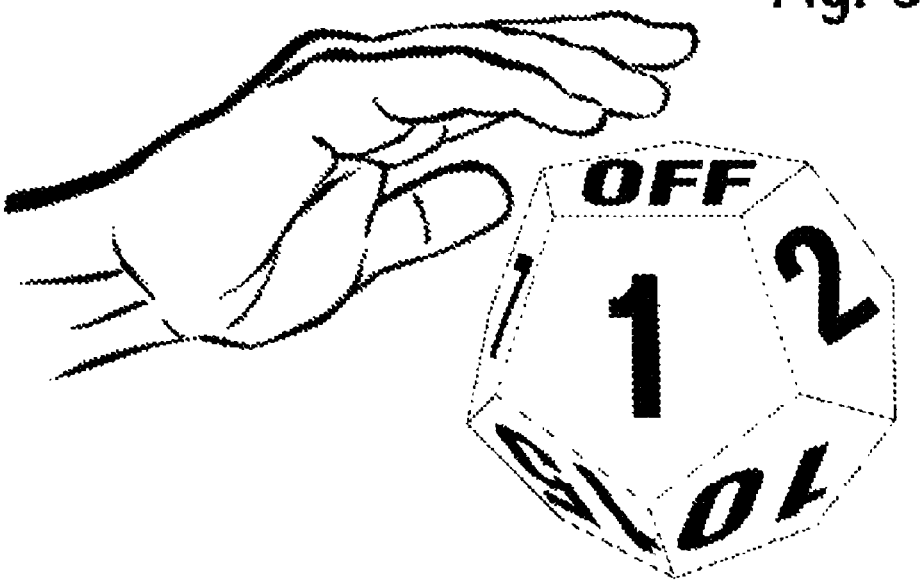
FIGS. 3A and 3B show the basic operation of setting a time interval.
Figure 3B:
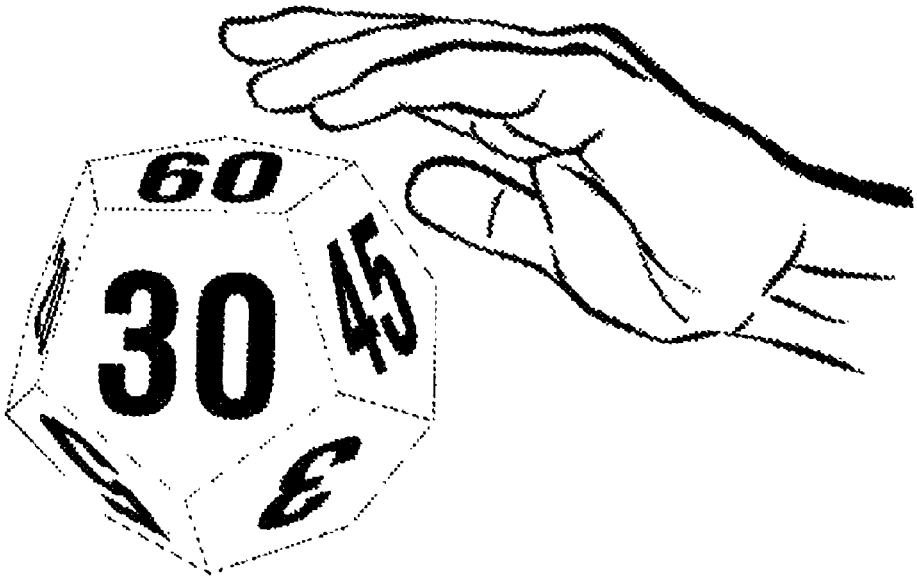

FIGS. 3A and 3B show a basic method of setting time. Starting with the OFF face uppermost, FIG. 3A, the timer is rotated so that a numbered face is uppermost, FIG. 3B. This is all that is required to set and initiate a time interval. FIG. 3B shows a time of 60 minutes being initiated. The timer need not be oriented with the OFF face uppermost to start. A previously set time may have completed, but the timer was never rotated back to have OFF uppermost. In this case, a new time may be set and initiated by simply rotating the timer so that the new time is uppermost. If the same time as the previously completed time is desired to restart, the timer need merely be picked up and set back down with the desired time uppermost. If a set time has completed, moving the timer so that the OFF face is uppermost does not start a new time. The timer is typically left or stored with the OFF face uppermost.

Figure 4:
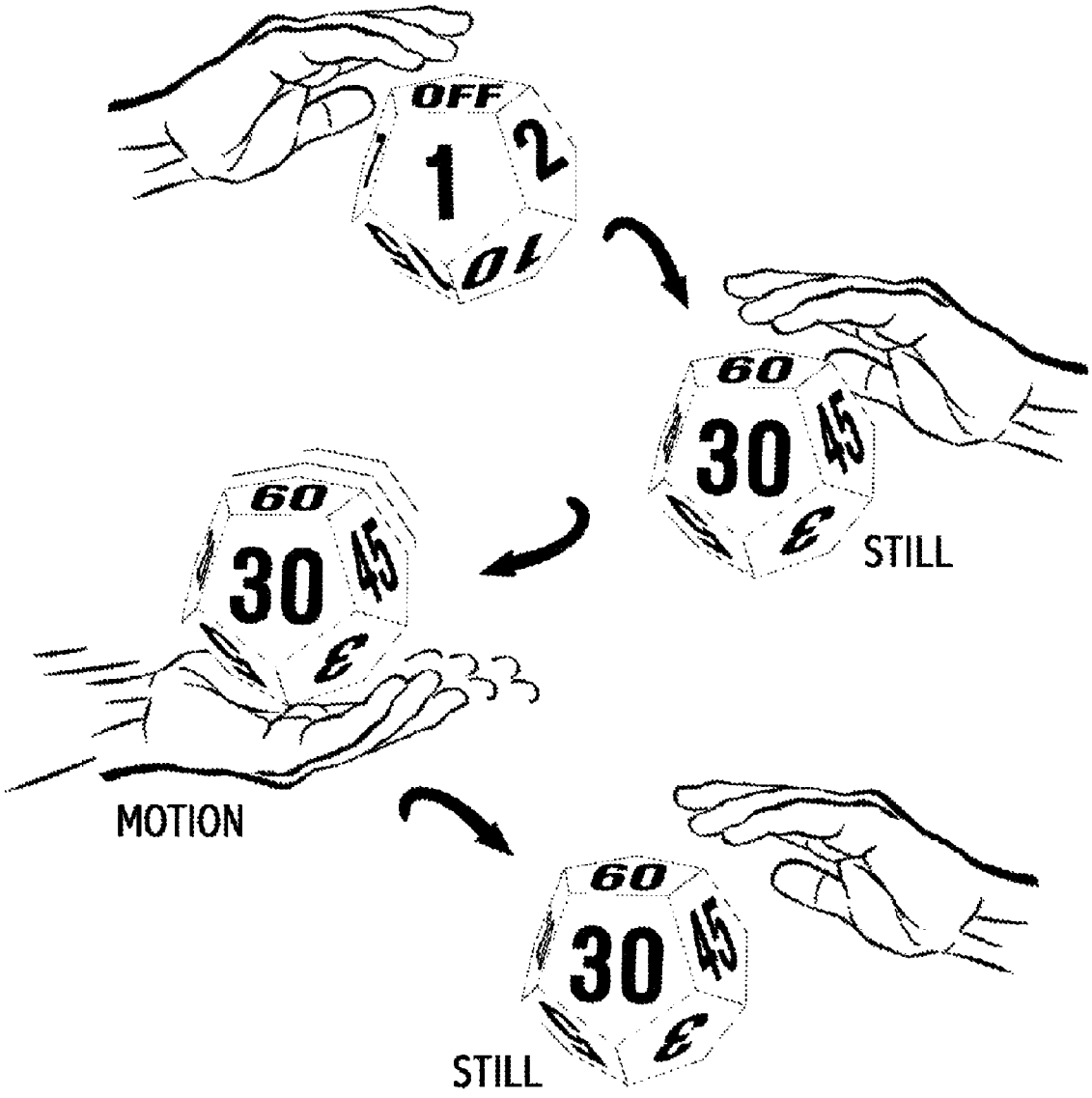
FIG. 4 shows how the timer may be transported without changing a time interval.

FIG. 4 shows a method of moving the timer while a time interval is in progress, while not resetting or restarting a time. Here, a time of 60 minutes is set by moving the timer from OFF uppermost to 60 uppermost, as shown in the first two images. The 60-minute interval is running. Now, the timer is moved to a different location, generally keeping the uppermost face still uppermost, as shown in the third image. The timer is then set down with the original time face still uppermost, as shown in the fourth and last image. In this example, the original 60-minute timer continues without change or pause. Ideally, the situation is confirmed to the user with an announcement, such as, "60 minutes still running. 31 minutes remaining." Note that in one embodiment turning the timer completely upside down (relative to its as-set position) causes that time interval to restart, rather than continue unchanged.

Figure 5:
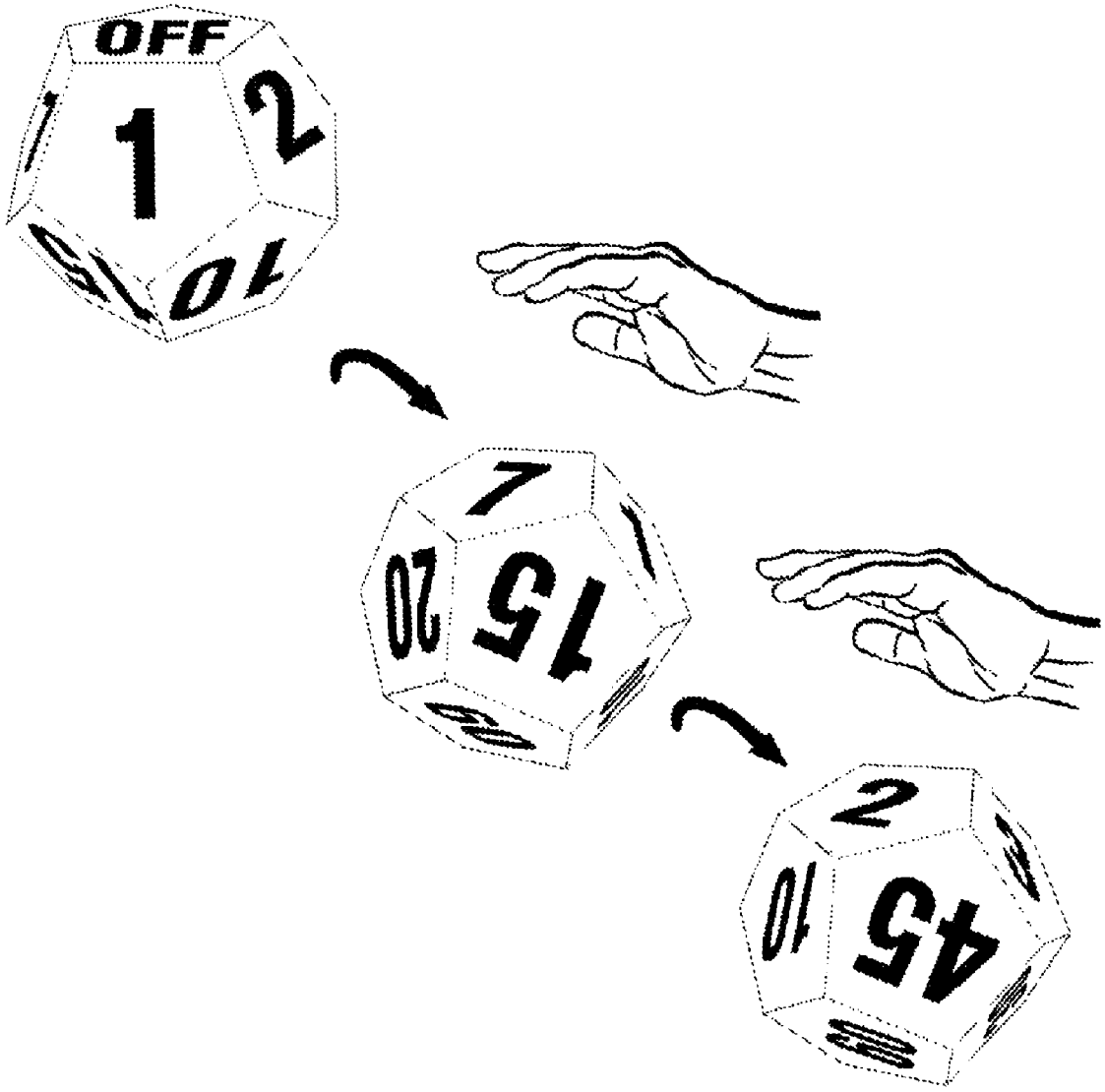
FIG. 5 shows how to create additive time intervals or set a new time interval.

FIG. 5 shows one of two timer actions, depending on embodiment, mode, timing between face changes or a combination. In the first action or embodiment shown in the Figure, the legends on the sides may be summed to set an interval equal to the sum of two or more sides. This Figure shows the timer being rotated from the OFF face uppermost to the 7 face uppermost. The 7 face remains uppermost and the timer remains still for a time period within a time period window, such as between 2 and 10 seconds. Then, the timer is rotated again so that the 2 face is uppermost and the timer is still for a time period. In this action or embodiment, a time interval of 7+2=9 minutes is set, and ideally announced. In some embodiments, this process may be continued, adding three or four or more sides to generate a total aggregate single time interval. Note that the timer must be still, typically resting on a surface without being touched, for at least a brief time in order to distinguish between this action and simply holding the timer, such as while trying to think of a proper time to set, or while trying to locate a desired face.

The second action or embodiment that is shown in FIG. 5 is changing from a first running time interval to a new time interval. In this example, a first time interval of 7 minutes has been set. Later, the user decides that the 7-minute time interval should be cancelled and new time interval of 2 minutes should be set. The timer is simply now rotated so that the 2 face is uppermost.

Distinguishing between the first action and the second action may be a matter of embodiment or mode. However, using a threshold time, such as 5 seconds (or in the range of 1 to 15 seconds, or 2 to 10 seconds) the desired action may be determined. That is, for example, if the timer is motionless (still) with the first face uppermost for less than 5 seconds, then the first action is used. If the timer is motionless with the first face is uppermost more than 5 seconds, then the second action is used. Note that this threshold time may be dynamic, learned, or predetermined.

Figure 6:
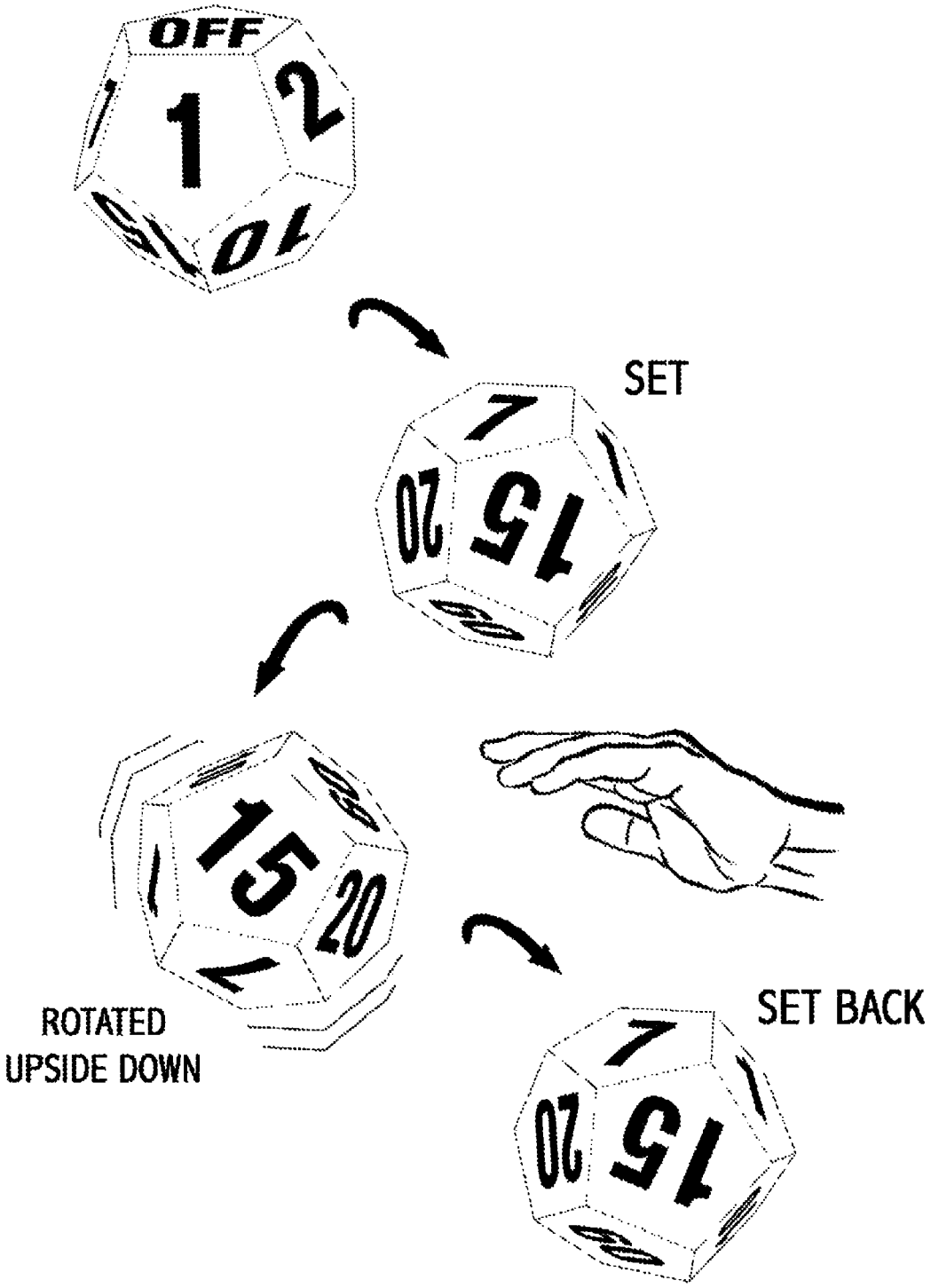
FIG. 6 shows how to restart a time interval.

FIG. 6 shows an embodiment of a method to restart a time interval. In this example, a time interval for 7 minutes is set. Later, the user wishes to restart the 7-minute time interval. The user picks up the timer and rotates it so that the uppermost face, here the 7 face, is approximately down, momentarily. The user then returns the timer with the 7 face uppermost. Ideally, the timer announces that the 7 minute time interval as been restarted.

It is necessary to detect whether the user desires to restart the current time interval or is merely moving the timer. A threshold angle may be used, for example, 90°. If the timer is rotated less than the threshold, it is being moved, without changing the in-progress interval. If the timer is rotated more than the threshold, the time interval is being restarted. Note that it is not necessary for the timer to be motionless. For such detection, is sufficient for the user to rotate it in the user's hand without setting it down. The rotation threshold is measured from the uppermost face (or last uppermost face) that determined the in-progress time interval.

Figure 7:
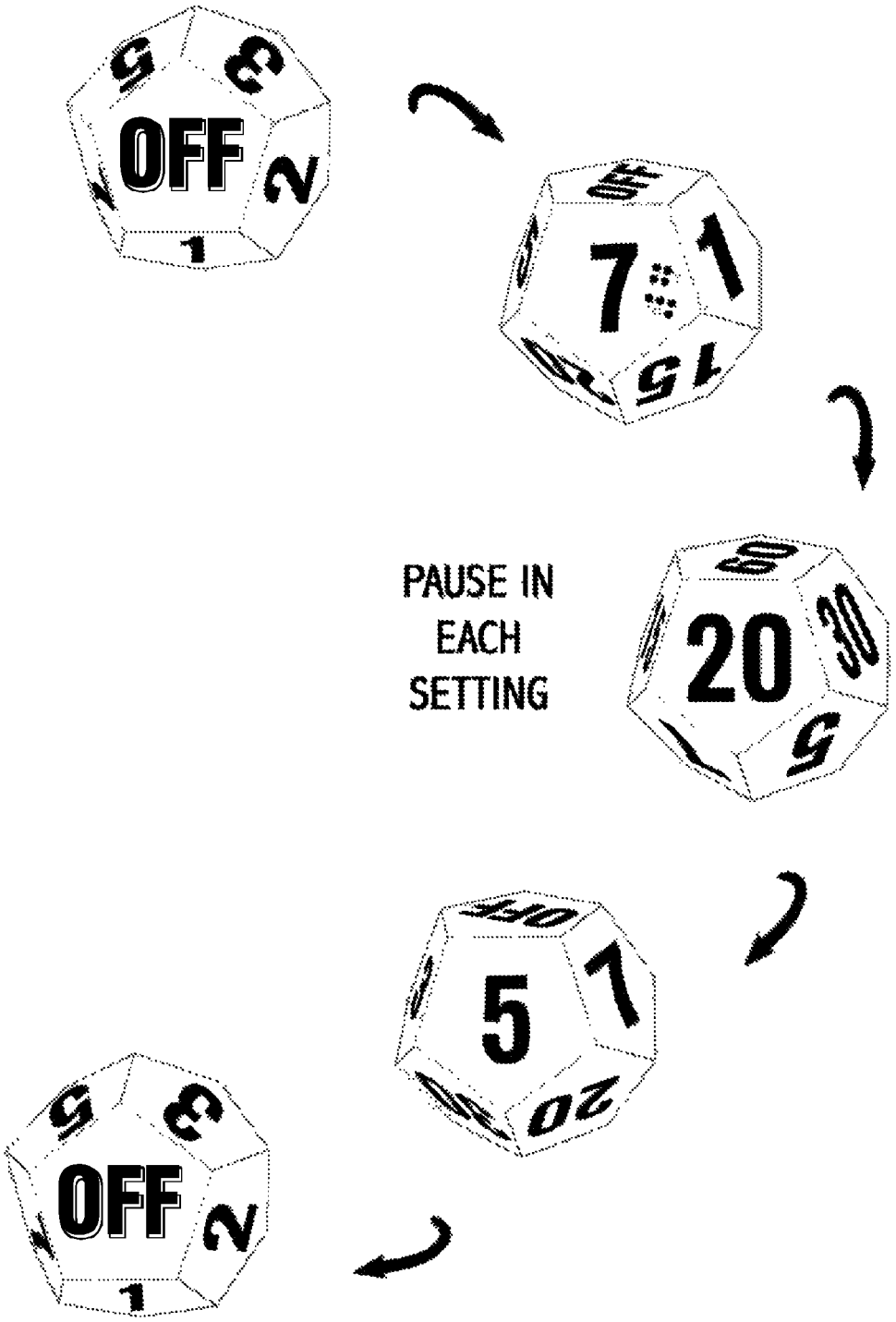
FIG. 7 shows an exemplary programming sequence, overhead view, plus legend options.

FIG. 7 shows a novel method of programming modes, as discussed elsewhere herein. Here, a sequence of OFF-7-20-5-OFF is shown. The views in this Figure are overhead views. Each face in the sequence must remain uppermost for a time period within a time threshold window, as discussed elsewhere herein. Such a time threshold window might be between 2 seconds and 10 seconds, or between 1 and 15 seconds, for example. Ideally, a new mode is announced following the successful completion of the sequence. When each face in the sequence is uppermost, the timer may also have to be motionless.

FIG. 7 also shows an embossed legend. Here, the "OFF" legend is embossed. Such embossing allows the timer to be used in the dark, or by the vision impaired.

FIG. 7 also shows a braille legend. Here the braille pattern for "7" is on the 7 face.

Figure 8:
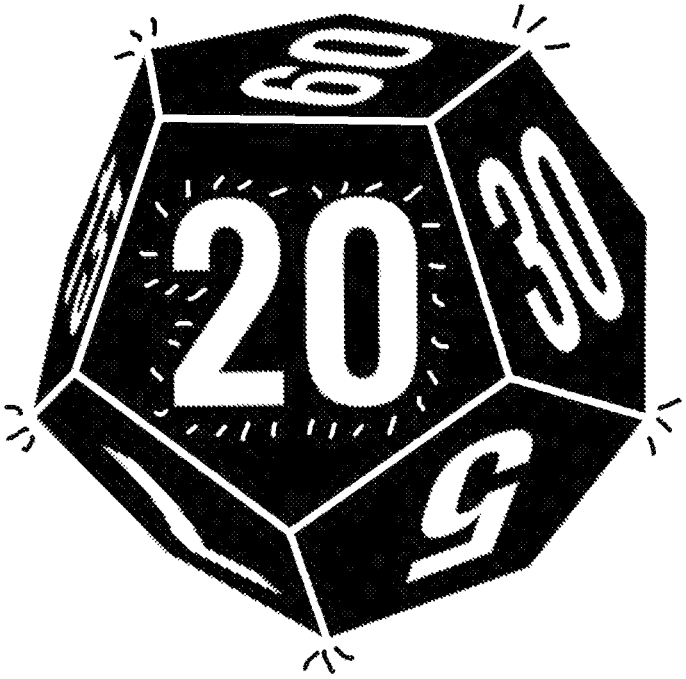
FIG. 8 shows an illumination embodiment.

FIG. 8 shows one embodiment of illumination. Here, the numerical legends are transparent or translucent so that light shines through them. Also, the edges of the dodecahedron are transparent of translucent so that light shines through them. Alternatively, legends may be opaque while the backgrounds are transparent or translucent.

Figure 9:
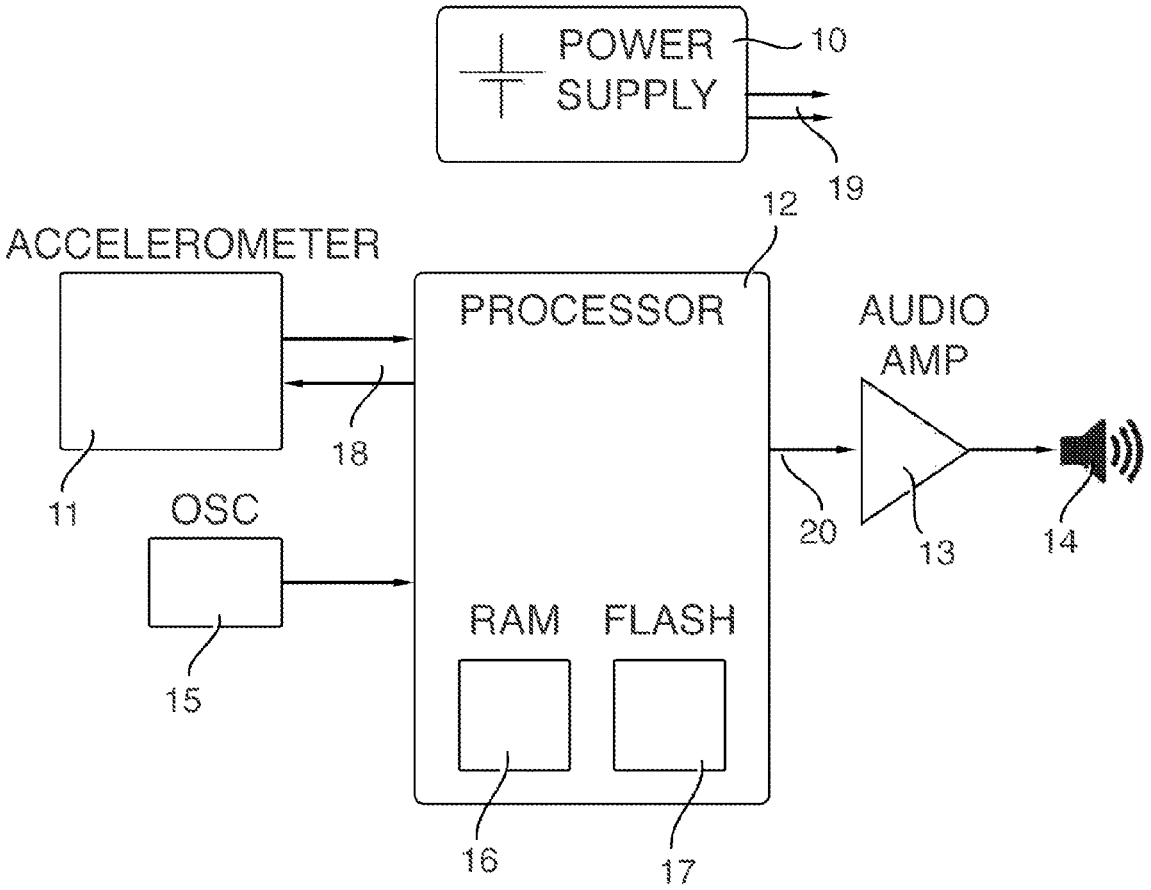
FIG. 9 shows an embodiment of an electrical block diagram.

FIG. 9 shows the electronic elements of one embodiment. A power supply 10 supplies power to the integrated circuits and other electronics. Multiple voltages may be needed, such as 3.3 V and 5 V, as shown by two outputs, 19. Input power to the power supply 10 may be one or more batteries, shown schematically in the Figure inside the power supply block, 10. Such batteries might be Nickel Metal Hydride, (NiMH), Lithium Ion, (Li-ion), or one of many other rechargeable or single-use battery technologies. In one embodiment, two 3.6 V cells are used to provide both 3.6 and 7.2 volts to voltage regulators. Exemplary voltage regulator ICs are LP38093 and LP2980. Some power supplies may be turned off under processor control to achieve a lower power state. Supercaps, such as PowerStor M-series may be used to provide short-term higher current, such as to briefly run an audio amplifier, 13, or light, not shown.

Continuing with FIG. 9, an accelerometer IC 11, is used to determine which face is up, and may also provide other information, such as that the timer is in motion, being rotated, or is being transported, or dropped, or shaken, or bumped, and the like. The accelerometer is also able to wakeup the processor 12, or provide an interrupt, on detection of certain selected motion events. An exemplary accelerometer 11, is a Freescale Semiconductor MMA8451Q. The ideal interface to the process is bidirectional, as shown by communication lines 18, as this allows the parameters of the accelerometer, 11, to be programmed.

Continuing with FIG. 9, the heart of the electronics in some embodiments is a processor 12. Those in the art know there are many different processors, processor packages, and configurations suitable. An exemplary processor is a Freescale Semiconductor MK64FN1MOVLL12. The processor has internal RAM 16, and program memory, such as Flash memory 17. Such memories may be internal to the processor IC, or external, or both. The Flash memory is suitable to hold both executable code and data, such as sound data for tones or speech output.

Continuing with FIG. 9, the timer ideally provides audio output via an amplifier 13 and speaker 14. More than one amplifier may be used and more than one speaker may be used. The amplifier(s) are fed by a signal 20, from the processor. Such a signal may an analog value, such as from a DAC, or a digital signal, which may be one-bit, pulse-width modulated, or multiple bits. Audio data may be straight audio samples, or may be compressed, or may be codes that represent sounds, phonemes, or portions thereof. In some embodiments, the audio amplifier or audio control circuit may draw its data directly from memory, such as by the use of DMA. An exemplary audio amplifier is MAX9730, PAM8302 or NXP TFA9887. The one or more speakers 14, are typically 4 ohms or 8 ohms, however, other values and types of speakers may be used, including audio transducers, such as PZTs.

Continuing with FIG. 9, an oscillator, 15, provides a time-base. The oscillator may be a crystal, such as 32 KHz, or a resonator, or a higher frequency crystal such as 8 MHz or 25 MHz, or an integrated oscillator IC. More than one oscillator or crystal may be used. The oscillator's signal may supply other ICs in addition to the processor, 12.

See Table 6, below, for a parts list of one embodiment.

Communication between the processor and peripheral chips may be a common multiplexed bus, such as I2C ("I-squared-C") or I2S ("I-squared-S").

Motion filtering. As the operation of the timer comprises rotating the timer until the desired time face is up, detecting such "setting motion" as well as other motions, is critical to reliable and intuitive operation of the timer. In addition, the timer may be moved for a long period of time not directly related to setting or clearing a time. For example, the timer may be running, and is being transported from one room to another room. As another example, the timer is being washed, either by hand or in a dishwasher. As yet another example, the timer may be being shipped, such as prior to first sale, or in a user's car from one location to another. It is important that such actions are identified in order to provide the expected operation of the timer while conserving power. This includes entering one or more low-power modes during transport and washing so as to not wear down the battery, and also to avoid repeated and undesired audio output from the timer.

In addition, the timer may experience small motions from vibrations, or being bumped, or being handled by a user with no intent by the user to change the current operating mode.

One way to assist in identifying these different types of motion is to define at least three time intervals, such as Ts, Tm, and Tl. These time intervals are used to categorize motion of the timer. Position changes at or less than Ts (short) times are generally ignored in that they do not change the timer state. Note, however, that some Ts or shorter actions do have meaning, such a timer being dropped or shaken. The time period Tm may be defined as greater than Ts and less than Tl. Timer position changes within this time interval are typically intentional by the user in that they indicate a desired timer state change. Such user-desirable stat changes may be called operational state changes. State changes that take Tl or longer typically indicate some activity other than normal use of the timer, as stated above, such as washing or transport. These time thresholds may change dynamically. In particular, the timer may "learn" these times by recording timer activity.

The raw output of the accelerometer is typically noisy. That is, some type of low-pass filtering is appropriate. This may be implement within the accelerometer, in hardware or software within the processor, or effectively by a state machine. For example, the position of the timer may be sampled periodically, such as 10 times per second. To recognize a motion within the Tm window, at least five consecutive time samples must indicate that the same timer side is up. Other values that these examples may be used. Accelerometer sample rates may range from 100 times per second to once every 10 seconds.

When we refer to "rotation" or "movement" or "an uppermost face," we are including suitable and well-known filtering of data from the accelerometer to reasonably match a user's perception of "moving" v. "still."

An exemplary motion table is shown below as Table 2. In some embodiments, additional time windows are used to filter timer position or determine state changes. Filters many include one-pole, low-pass filters, multi-pole low-pass filters, band-pass filters, sampling filters, delays, thresholds, other filtering algorithms, or combinations.

TABLE 2

Motion Table

| Motion Length | Action |
|---|---|
| Short, Ts | Timer rotation changes within this time are ignored. These may be a bump or vibration. This time window may be 0 ≤ time ≤ Ts. |
| Medium, Tm | Timer rotation changes within this time window are assumed to be user generated motion to change timer state. This time window may be Ts < time < Tl. |
| Long, Tl | Long continuous motion, such as carrying, washing or transport, are characterized by motion not stopping (longer than another threshold) within this time window. This time window may be time ≥ Tl. |

Figure 10:
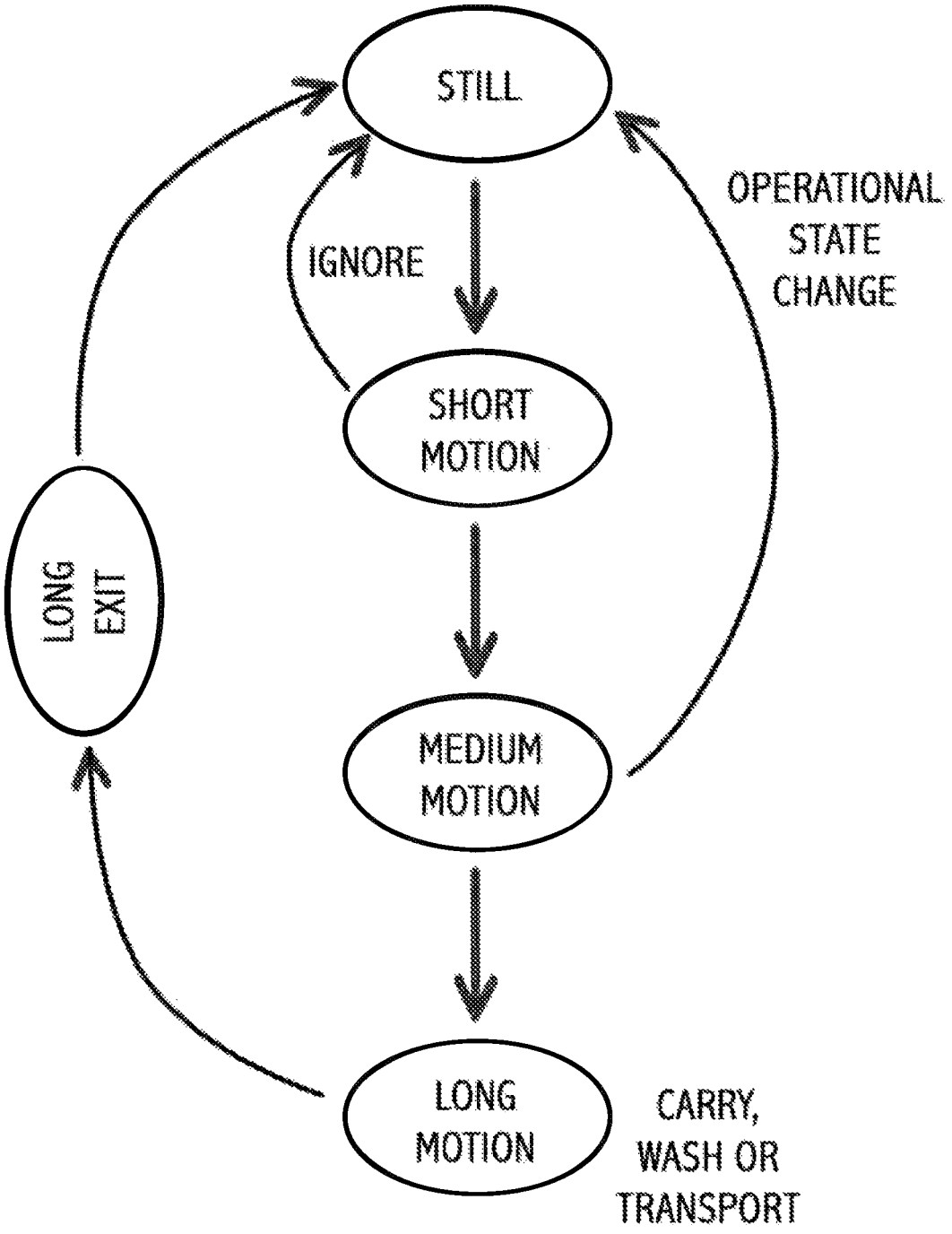
FIG. 10 shows an embodiment of a timing state machine.
Figure 11A:
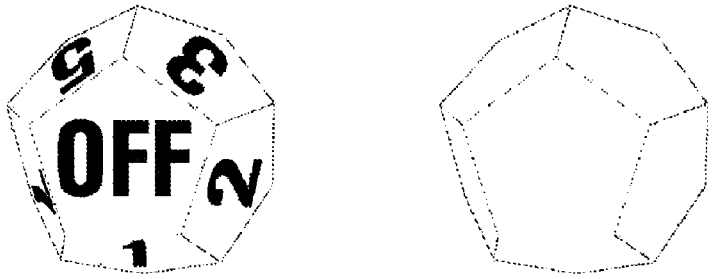
FIGS. 11A, 11B and 11C show respectively embodiments for N=6, N=8 and N=10.
Figure 11B:
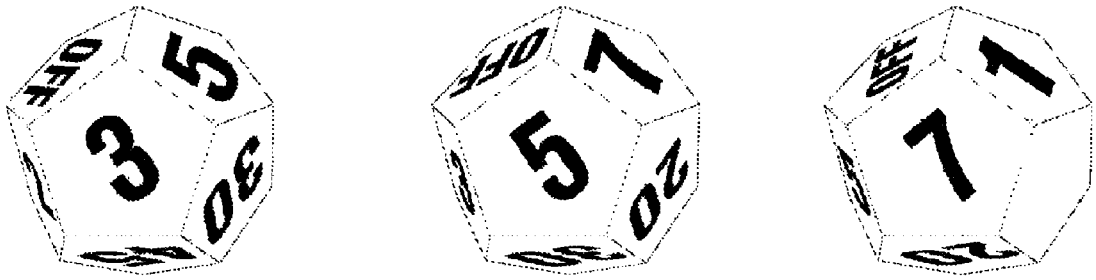
Figure 11C:
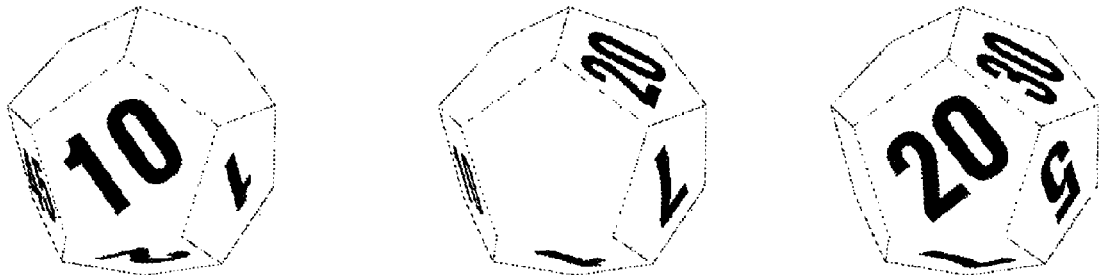

FIG. 10 shows one embodiment of internal timing state changes. The bubbles, STILL, SHORT, MEDIUM and LONG represent internal states related to the length of time the timer has been in continual motion (including some still times within the continual motion). "Continual" may include some low-pass filtering of motion sensing. STILL refers to the state of non-motion, such as sitting on a surface. SHORT refers to motion times that should be ignored, which might be result of vibration, or a table being bumped, for example. MEDIUM is the length of time the timer is motion that should typically result in a user-visible state change, such a setting a time, changing a time, cancelling a time, and the like. The transition from MEDIUM to LONG is generally an indication that the timer is being carried to a new location by a user, that it is being washed, or is being transported. Exiting from this mode depends on global modes, and whether or not the timer was running at the start of the LONG motion (or when STILL was exited). If the time was running, typically a carry operation may be assumed, and the timer continues to run, or a new time is set. Exiting from wash or transport is discussed elsewhere herein, as shown by the bubble LONG EXIT, and typically results in no announcement when the timer is again STILL from this state. Exiting from a CARRY state preferably generates a message when the timer is again STILL.

Operation of the timer, from the point of view of an end-user, as well as for internal operation, may be described by the use of timer states, which may be called operational states. Those trained in the art know that many different state diagrams may be used to provide the same or similar effects. One such state table is shown below in Table 3, below.

TABLE 3

Timer Operational State Table

| State Name | State Definition |
|---|---|
| OFF (O) | Timer is off and in low power mode. OFF face is up. |
| TIMING (T) | Timer is running a set time interval corresponding to side that is uppermost, or to a sum of consecutive uppermost sides. |
| NEW TIME (NT) | Timer is started for a new user-time, from either TIMING (T) or COMPLETE (C) state. |
| SAME TIME (S) | Timer is restarted to the just-previously set user-time, from either TIMING (T) or COMPLETE (C) state. |
| RESTART (R) | Running timer time interval is restarted. |
| COMPLETE (C) | A set time interval completes. |
| MOTION (M) | Medium-term motion, such as user moving from one room to another, or changing timing modes. |
| TRANSPORT (Z) | Continuous motion, such as shipping, cleaning, washing or playing. |
| POWER DOWN (D) | Timer is off, but still has a previously uppermost face from the COMPLETE (C) state, uppermost. |
| PROGRAMMING (P) | A global operating mode is being set. (See text.) |

Both the internal logic of the timer and the user's perception of "what the timer is doing now" may be represented by an "operational timer state." Exemplary operational states are listed above in Table 3. Table 4, below shows exemplary operational state changes.

TABLE 4

Operational State Change Table

| State Change | Example |
|---|---|
| OFF to TIMING (OT) | Timer is rotated from OFF to a set time. Motion interval is Tm. |
| OFF to MOVING to OFF (OMO) | Timer is rotated from OFF, ending up in OFF. Movement time may be in the windows of Ts, Tm, or Tl. |
| OFF to PROGRAMMING (OP) | From OFF, timer is rotated through a specific sequence of faces. See text |
| TIMING to OFF (TO) | From Timing (T) state, timer is rotated to |

TABLE 4-continued

| Operational State Change Table | |
|---|---|
| State Change | Example |
| | OFF (O). Motion interval is Tm. |
| TIMING to NEW TIME (TNT) | From a first Timing (T) state, timer is rotate to a new, different time and face, which terminates the previously running time and initiates the new time. Motion interval is Tm. |
| TIMING to ADDITIONAL TIME (TA) | From a first Timing (T) state, timer is rotate to a new, different time and face, which additively sums the previous interval value with the new face value to create a new interval value. These actions may or may not be repeated, such that three or four different faces may be added to create a new time. Motion interval is Tm, or possibly a lower value, such that the "still face" time may be less, to minimize the wait required by the user when setting a sequence of faces for an additive time. |
| TIMING to MOVING to SAME TIME (TS) | From Timing (T) state, timer is rotated, but returned to the same time, that is, same face as before is up. Motion interval is Tm or Tl, but total rotation is limited - see text. |
| TIMING to RESTART TIME(TR) | From Timing (T) state, timer is rotated, but returned to the same time, that is, same face as before is up. Specific motions are required. See text. |
| TIMING to COMPLETE (TC) | From Timing (T) state, time interval expires. No motion is required. Timer still has the previously set time face up; timing is complete. |
| COMPLETE to OFF (CO) | From Complete (C) state, the timer is rotated to OFF. |
| COMPLETE to NEW TIME(CN) | From Complete (C) state, the timer is rotated to a new time. |
| COMPLETE to SAME TIME (CS) | From Complete (C) state, the timer is rotated, and then returned to the same time. Specific motions are required. See text |
| COMPLETE to POWER DOWN( CD) | From Complete (C) state, the timer enters power down state (D); no motion is necessary. |
| TRANSPORT to OFF (ZO) | See text. |
| TRANSPORT to COMPLETE (ZC) | See text. |

The user may not be aware of all power-down states internally in the timer. In some embodiments, it is desirable to have more than one power-down state. For example, when the timer is timing, state (T), no internal activity is necessary until one of events occurs: either the timer is moved, as the accelerometer may detects motion, or an internal timer expires. The timer may use an internal time base to wake up the processor periodically. For example, the electronics may "wake up" once every second to see if the user's set interval has expired. In addition, an interrupt from the accelerometer may wake up the processor.

However, for some activity such as transport or washing, a different low power mode is desired. For this low power mode, the timer may not enable accelerometer interrupts.

In some embodiments, various operating modes are desirable. For example, the timer may generate output messages in English, or French, or in another language. As a second example, there may be more than one model of timer, with different values on the faces. As a third example, a user may which to change the operating mode. For example, there may be "verbose" mode where the timer provides frequent audio feedback, or a "quiet" mode where only the completion of set times causes audio output. A user may select a male or female voice, as yet another example.

In general, we may think of two types of "programming" of such timer modes: The first type is mode of operation set by a factory, distributor or retailer. The second type of mode of operation is set by an end-user.

For either type of mode programming, a novel method of programming is to rotate the timer through a particular sequence of up sides, within particular time periods. For example, rotating the timer from OFF, to 7, to 60, to 5, and then back to OFF, with each side staying up for a time period between 1 second and 10 seconds (for example) may be a recognized programming sequence to cause a particular operating mode to be set, until changed by another programming sequence.

Such programming has the advantage that a single electronics module may be used for a large number of different timer modules sold into different markets.

Table 5, below, provides an exemplary set of audio announcements. These announcements are also called message or phrases. All audio text examples in the Table are single exemplary examples of a specific operational state change.

TABLE 5

| Exemplary Audio Messages | |
|---|---|
| Operational State Change | Example Audio |
| OFF to TIMING (OT) | Set time is announced, "Three minutes." |
| OFF to TRANSPORT to OFF (OZO) | Silent. |
| OFF to PROGRAMMING (OP) | See text. |
| TIMING to OFF (TO) | "Timer is off." Alternate: downward, drooping tone, or a large water droplet. |
| TIMING to NEW TIME (TN) | Old and new times given, "Fifteen minutes cancelled. New time of five minutes set." |
| TIMING to ADDITIONAL TIME (TA) | New, summed time is announced, "Timer is (now) set for 52 minutes." The "now" may be announced only if the time for the first face has already been announced. |
| TIMING to MOVING to SAME TIME (TS) | Continuation message, "Fifteen minutes still running. Eleven minutes left." |
| TIMING to RESTART TIME (TR) | Restart message, "Twenty minutes restarted from beginning." |
| TIMING to COMPLETE (TC) | Happy tone, followed by completion message, "Your hour is up." |
| COMPLETE to OFF (CO) | "Timer is off." |

TABLE 5-continued

| Exemplary Audio Messages | |
|---|---|
| Operational State Change | Example Audio |
| COMPLETE to NEW TIME (CN) | Time is announced (same as for OT), "Forty-five minutes." |
| POWER DOWN (D) to SAME TIME (DS) | Same-time announcement, "Ten minutes, repeated." |
| COMPLETE to POWER DOWN (CD), POWER DOWN to OFF (DO) | Silent. |
| TRANSPORT to OFF (ZO) or TRANSPORT to COMPLETE (ZC) PROGRAMMING (P) | Silent "Programming started," "Programmed for ≪xyz≫ mode." Note: programming may only start from OFF. ≪xyz≫ represents a particular mode. |

Operating Modes. Operating modes may be viewed as either global or local. Global modes refer to the overall operation of the timer—which rotations cause which states, actions and outputs. Local modes may also be called operational states, as discussed above. Typically operational state changes are caused by (i) one or more rotations, or the cessation of rotation; (ii) movement, or the cessation of movement, (iii) a timer interval being initiated, completed, or updated; or (iv) an internal time period has passed. Generally, the user causes (i) and (ii), above, while the normal function of the timer causes (iii). Cause (iv) is used for filtering of (i) and (ii), and for changing into or out of power-down states or modes.

Global modes may be set at a factory, or a distributor, or a retailer. These modes may be for different time models, different feature sets, different target markets, different languages, or to change a timer from a shipping mode to a user mode, or vice-versa. In some embodiments, users may also set one or more global modes.

A shipping mode is advantageous to keep battery drain as low as possible during shipping—until it is in the user's hands. Generally, no audio output during this mode is preferred, and "sleep times" for the processor, accelerometer, and other electronics should be as long as possible. Waking up the timer from a shipping mode to a user mode (or a "retail" mode, or a "demo" mode) may require a longer-term action, such as shaking for at least 10 seconds, or a series of taps. A particular orientation may be used, or also required. For example, timers may normally be shipped with the "OFF" side up. If a shipping box is placed upside down, or on its side, then the angle of rotation is 180° or 90° from the OFF orientation. These angles may continue a shipping mode, if one is already in progress. Note that an operating timer, on a level surface, would not stay at a 90° angle. One way to exit shipping mode would be to place timers on some other side, such as one of the five faces surrounding OFF, for a time period, perhaps one minutes or more. (Time periods of 1 to 1000 seconds, or 5 to 500 seconds, or 10 to 100 seconds, or over 5, or over 10, or over 30 or over 60 seconds may be used for this exit-from-shipping-mode change.) Retail boxes for the timer may include the ability to place the retail box at such an angle to effect this exit-from-shipping-mode. Ideally, the timer generates an audio message when it exits the shipping mode.

Dishwasher mode. It is desirable to permit users to place the timers in a dishwasher. While in the dishwasher, it is desirable to minimize power use and also to minimize or avoid completely audio announcements. Generally, dishwashers create frequent motion due the water spray or mechanical vibration. This frequent motion may be detected, causing the timer to enter dishwasher mode. Such a time period of frequent or constant motion may be more than 10 seconds, or more than 20, 30, 60, 120, 180, or 240 seconds. Exiting the dishwasher mode may occur when the timer is still for period of time, and has a face reasonably level (such as within 5, 10, 15, 20, 30, or 45 degrees) such as more than 10 seconds, or more than 20, 30, 60, 120, 180, or 240 seconds. In addition, the timer may need to have a particular face up, such as OFF. An alternative, or additional way to exit dishwasher mode may be to shake the timer for a minimum time period, such as more than 0.5, 1.0, 1.5, 2, 3, 5, 7, 10, 15, 30, or 60 seconds. Hand washing may also be treated as dishwasher mode, but not necessarily.

Reset to default operating mode. It may be desirable to permit a user to reset operating modes to a known default. One way of achieving this reset is to shake the timer for a minimum period of time. Such a time period of frequent or constant motion may be more than 10 seconds, or more than 5, 20, 30, 60, 120, 180, or 240 seconds. In addition, a particular face may need to be uppermost at the termination of the shaking, such as the OFF face.

Programming modes. Global modes may typically be set at a factory, or a distributor, or a retailer. These modes may be for different timer models, different feature sets, different target markets, different languages, or to change a timer from a shipping mode to a user mode, or vice-versa. However, it may be desirable to allow users to also set global modes, although the set of possible user-available modes is likely to a different set than possible modes set by the factory, distributor, or retailer. A novel method of programming global modes is to rotate the timer through a predetermined sequence of uppermost sides, with one sequence for each desired mode. The necessary time period for each uppermost face in the sequence might be in the time range of 0.5 to 90 seconds, 0.75 to 30 seconds, 1 to 15 seconds, 1 to 10 seconds, or 1 to 5 seconds. Sequences may be two, three, four, five, six or more faces. For example, one such sequence is: starting from OFF (no maximum time limit) then to 7, then to 20, then to 5, and then back to OFF (no maximum time limit). There may be sets of modes that are restricted to one mode per set (e.g., language). There may be sets of modes where the mode is independent of other modes, such as a verbose mode, or a ticking-while-running mode.

Actions that may also be used for setting modes, which may be stand-alone actions, or may be combined with the above face-sequence actions include shaking or tapping. Taps may be counted. Counted taps to change mode may include 1, 2, 3, 4, 5, 6, 10 taps, or a range of taps, such as 2 to 3, or 3 to 5, or 5 to 10 taps.

Non-limiting examples of modes are: language of announcements; tones used in announcements; gender or accent of voice for announcements; length of announcements; verbose v. standard v. quiet mode; ticking on or off; vibration threshold; announcement volume; entering or exiting a shipping mode; reset to one or more default modes; audio output, visual output, or both; entering or exiting a retail or demo mode.

Modes settable by the user may be cycled through a sequence by shaking the timer. For example, modes may be sequenced from normal to verbose to quiet, and then back to normal, each time the timer is shaken. Modes may be set by the number of taps. For example, four taps sets standard mode, five taps sets quiet mode, and six taps sets verbose mode.

For timers with wireless communication, one or more change actions described above may enable or disable wireless communication.

Retail mode. It is desirable to have a retail or demo mode. Such a mode might be viewed as intermediate between shipping mode and user mode. Such a mode might include product demonstrations, product use instructions, or might prohibit certain other mode changes, or combinations. For example, a product demonstration might be simply announcing an uppermost face, for example, "ten." However, this demonstration might not require the timer to be still. Thus, it may provide this audio demonstration while being held. This is distinct from normal operation, where the intent of the user is typically not determined until after the timer has stopped moving. The retail mode may also be tolerant of some vibration, without making an audio announcement or changing mode. A "demo" mode might be the same as a retail mode, or may be a separate mode.

Instruction mode. It is useful to provide a mode whereby the timer provides audio instructions. Such a mode may be temporary, in that when the audio instructions have been completed, the mode exits. Such a mode may be entered by any of the mode change actions described elsewhere herein. For example, shaking for a minimum time period may cause entry into the instruction mode. Also, exit from retail mode to user made may cause instructions to be first provided.

Dropped mode. Ideally, the timer withstands drops without damage. However, it may be desirable to provide a unique audio message following a drop, such as "Ouch!" or "Please do not drop the timer." The timer may provide such an audio message only once per a time period (such as once per hour, or once per day) to minimize users making a game out of dropping the timer.

The timer may make an announcement after a cleaning mode, such as "I am now squeaky clean." Some messages may vary. Such variation may be random.

Carrying mode. The user, after a user has set it, frequently moves a timer. In this case, the user typically does not wish to change or cancel a running interval. In some embodiments, the timer detects that it is being moved and does not change a running interval. One way to do this is to note the maximum angle that the timer is rotated from its starting position while being moved. If (a) the timer is not rotated more than a first angle (such as an angle in the range of 5° to 100°, or the range of 10° to 90°, or the range of 15° to 60°, or the range of 20° to 50°); and (b) the timer is placed at the end of the carry movement so that the previously uppermost face is again uppermost, then carry mode may be assumed and the previously running interval (or intervals) are continued without interruption. It may be advantageous to make such an announcement, for example, "previously set time of 10 minutes still running," or, "3 minutes left out of 30 minutes."

Intermediate time announcements. Some people would like to know how much time is left on a running interval. A novel user action to cause a time remaining message to be announced is to pick up the timer, tilt or shake it, and place it back down with the original side face up again. Alternatively, the timer may be tapped to cause a remaining time announcement.

Weak battery mode. It may be desirable to notify the user with an audio message when the battery is low. This mode may include instructions to the user on how to remedy the problem. For a sealed, non-rechargeable battery, the instructions may include how to return the timer or how to purchase a replacement. For replaceable or chargeable batteries, the instructions may include how to replace or recharge the battery. If there is a charging stand, the timer's announcement may be, "Please place the timer on the charging stand."

Charging. In one embodiment, batteries are not chargeable. For embodiments with chargeable batteries, batteries may be charged through timer case via electrical contacts, typically on the face opposite the OFF face; or may be charged via light; or may be charged via an electromagnetic or electric field coupling through the case, as those trained in the art understand. A Near Field Communication coil may be used for both communication and charging. Ideally, a receiver for electromagnetic or electric field coupling is on the face opposite the OFF face.

For charging via light (using "solar cells," as a receptor, for example), the receptor may be on or under any one or more faces. A novel method of charging via light is place the receptor on the face opposite the OFF face, then use a charging base that provides upward directed light to the timer, so that it may charges while sitting on the charging stand, with the OFF face up. The charging base and receptor may use infrared (IR) light, for example, permitting the use of low-cost and highly efficient infrared LEDs and receptors. Also, the use of IR for charging is minimally intrusive. A novel feature of the capability is the use of an IR filter on or behind a face, such that the receptor is not generally visible. Such a face may be, or may appear to black, or dark. For example, a face with a legend of "60," may comprise a white legend on a black or dark background. Any charging stand may or may not detect the presence of a timer on the charging stand.

Electronic interface. In some embodiments, the timer is programmable via a wireless electronic interface. Such an interface may be audio (including frequencies above or below normal human hearing), IR data, Bluetooth, WiFi, Cellular data, Near Field Communication (NFC), or other interfaces. Non-limiting examples of programmability include: firmware, operating modes, sounds or musical tones, messages, and optional features. One novel embodiment implements bi-directional digital communication using audio signals. High-quality audio messages may be updated reliably via such a digital audio interface.

Replaceable faces. Some embodiments include replaceable face legends. This replacement may be done at the factory, a distributor, a retailer, or a user. Reasons for changing face legends include: allowing a different set of times to be implemented; implementing a different language on the legends; use of opaque, translucent or transparent faces; and special features. One method of changing faces is the use of stickers. The previous face legends, if any, may or may not be removable. Another method of changing faces is to provide a slot on a face, into which is placed a legend. The slot method has the advantage of providing a rugged cover over the legend. The use of transparent of translucent faces permits the use of an internal light that is visible, when illuminated, by users. Face legends may cover an entire face, a portion of a face, or cover no more than the legend itself.

Internal light. In some embodiments, the timer has one or more internal lights. In one embodiment, an internal light illuminates when a timing interval completes. This light may be on steady or pulse for example. It may stay on until the timer is moved, up to some time limit, such as one minute. (A suitable range may be 10 seconds to 240 seconds, or 20 to 180 seconds.) The light may be a flash lamp. Such an output is suitable for people who are hearing impaired. Visual output may be combined with audio output, or it may be the only notification of timer interval completion. If internal light is used, one or more faces should be at least partially transparent or translucent. The timer may be manufactured from transparent or translucent plastic. In one embodiment, light exits the timer case through the edges of the dodecahedron.

Braille. In one embodiment, legends on one or more faces are in braille, or are embossed legends, such that a blind or sight impaired person can identify a face by feel. Also, textures may be used to identify one or more faces. Also, such tactile faces may be used at night, or for people who do not have on their glasses. In one embodiment, the OFF face has a distinctive texture or other tactile uniqueness. This allows the timer to be easily turned to the OFF rotation, entirely by feel, even for those people who are not sight impaired (such as at night). Tactile legends, of course, may be combined with visual legends.

Communication Modes. Some people like their timer to be highly communicative. Some people like their timer to talk as little as possible. In some embodiments, various operating modes permit either the user, or a manufacturer, distributor or retailer to set a "verbosity" mode. Three such possible modes may be identified as: "verbose," "normal," and "quiet." In a verbose mode, for example, more information is provide, which might including ticking, or regular intermediate time announcements, or more instructions. In a quiet mode, for example, only completion of time intervals generate audio messages, and, possibly, a minimal indication that a time has been set, such as a short tone. Alternatively, for quiet mode, at the start of the time interval the interval length is announced; then, at the completion of the time interval a simpler output is provided, such as a basic alarm or tone, such as a "ding." Some people like their timers to tick—this provides some assurance that the timer is running. Turning on and off ticks may be an optional mode. Ticks may be provided in the verbose mode.

Modes may include a "simple" mode and an "advanced" mode. An advanced may included more features or options. A simple mode may limit features or options so as to provide more consistent operation.

Modes may include specific sets of features aimed at a particular target market. For example, for classroom use, setting exact time intervals may be important. For use by the elderly, simpler operation (and possibly maximum volume) may be important. For use in a garden, uppermost faces may not need to be horizontal to be recognized. For use in some teaching or therapy environments, low volume and minimal messages may be appropriate. For use in factories or noisy environments, high volume and attention getting sounds, as well as a requirement for announcements to be positively recognized, may be important. Various sizes of the timer may be appropriate for different environments or target markets. For example, for use outdoors, a large timer may be desirable.

Press to start. Ideally, there is no drain on a battery between manufacturing and first use by as user. Some products use an insulating spacer between a battery terminal and a mating connector. The user removes the spacer to electrically connect the battery. A sealed product does not well support this method. A novel method of engaging a battery comprises having a timer case comprising two portions (such as a left and right half). The two portions are pressed firmly together to connect a battery via a mechanical switch or contact points. This pressing together of the case portions may be non-reversible. That is, through the use of barbs, ratchets, clips, snaps, adhesive, or other structures, once the case portions are firmly pressed, they cannot be parted. A seal may be provided between the case portions, such as a rubber O-ring, pressure adhesive, or a press-fit seal. Thus, pressing the case portions together not only connects the battery, but also effectively seals the case, in this embodiment.

Table 6, below, lists hardware, software, and development components for one embodiment.

TABLE 6

Parts List for One Embodiment

| Function | Component |
|---|---|
| IDE | Freescale KDS build 2.0.0.0. Source: www.freescale.com |
| Software Tool | Processor Expert plugin for Eclipse. Source: www.freescale.com |
| Real Time OS | FreeRTOS v8.0.1. Source: www.freertos.org |
| C runtime library | C runtime library. Source: GNU |
| Software debug tool | GDT debug server with PE micro using OpenSDA Source: KDA |
| Printf( ) monitoring | RealTerm. Source: www.realterm.com |
| 3D CAD | Solidworks. Source: www.solidworks.com |
| Application Note | Freescale Semiconductor AN3461, "Tilt Sensing" |
| Speaker | Breitband-Systeme VF45 - 4 Ohm |
| Speaker (alt) | Tymphany PMT Series 20N12AL04 |
| CPU reference schematic | Freescale Semiconductor FRDM-K64F |
| Audio amplifier | Diodes Incorporated PAM8302A |
| Audio amplifier (alt) | Maxim MAX9730 |
| Audio amplifier (alt) | NXP TFA9887 |
| Processor | Freescale Semiconductor MK64FN1M0VLL12 |
| Crystal | 32.768 KHz |
| Crystal, secondary | 25 MHz |
| Accelerometer | Freescale Semiconductor MMA8451Q |
| Supercap | PowerStor M0810-2R5105R |
| +5 V regulator | Texas Instruments LP38693 |
| Low power regulator | Texas Instruments LP2980 |

In one embodiment, the timer is free of buttons, free of visual electronic indicators and free of any visible light source.

In one embodiment, an end-user may change operating modes to select output phrases in one of two or more languages and may select audio outputs to be tones instead of linguistic phrases.

In one embodiment, the timer records any combination of: set time intervals, motions, and user actions; and has the capability to upload this recorded information to a remote database.

In one embodiment, the timer records activity and adjusts its internal time thresholds or its motion sensitivity responsive to the recorded activity.

In one embodiment, an end-user may enable wireless communication with the timer by shaking, tapping or sequencing through a predetermined set of uppermost faces.

In one embodiment the timer comprises a microphone, which may also be a speaker, or not, and the timer is responsive to digital audio input received by the microphone. Such digital audio may be provided by audio output from a computer or smart phone app.

In one embodiment the timer may be washed in a dishwasher, and the timer detects this activity, and adjusts its power responsively.

In one embodiment the timer may be autoclaved. In one embodiment the timer case may be chemically sterilized.

In one embodiment, following a movement of the timer during a previously initiated time interval, if the previous uppermost face is again uppermost when the movement of the timer ceases, the previously initiated time interval is continued from the initiation of that time interval, provided that the timer is not rotated more than a predetermined angle away from the previous uppermost face.

In one embodiment, following a movement of the timer during a previously initiated time interval, if the previous uppermost face is again uppermost when the movement of the timer ceases, the previously initiated time interval is restarted, provided that the timer is rotated more than a predetermined angle away from the previous uppermost face.

In one embodiment, shaking the timer, then placing it so that the OFF side is uppermost, resets the timer to a default operating mode.

In one embodiment, tapping the timer, or shaking the timer, causes it to provide audio instructions for use.

In one embodiment, the distinction between setting an additional time interval (two different time intervals running concurrently), and creating a new, single time interval that is the sum of two or more uppermost faces in sequence, is determined by comparing the time [from the first face being still to the second face being still] to a threshold value.

In one embodiment, the electronic interval timer of claim 1, wherein rotating the timer case, prior to expiration of the first time interval, initiates a second time interval responsive to a second legend on a second, now uppermost, face.

In one embodiment, the electronic interval timer of claim 1, wherein rotating the timer case, prior to expiration of the first time interval, initiates a second time interval responsive to a second legend on a second, now uppermost, face, and the first time interval and the second time interval run concurrently.

In one embodiment, the electronic interval timer of claim 1, wherein rotating the timer case, prior to expiration of the first time interval, initiates a second time interval responsive to a second legend on a second, now uppermost, face; and when the second time interval run is initiated the first time interval is canceled.

In one embodiment, an electronic interval timer comprising a case in the shape of an icosahedron or truncated icosahedron, wherein rotating the timer case initiates a first time interval corresponding to a first legend on a first uppermost face of the case. In some embodiments, all features, options, modes and claims described for a dodecahedron are also claimed for other polyhedrons with more than six sides.

In one embodiment, an electronic interval timer free of buttons, knobs, springs, time displays and openings in the case.

In one embodiment, an electronic interval timer free of buttons, knobs, springs, time displays, electronic visual indicators and openings in the case.

In one embodiment, an electronic interval timer wherein the timer case comprises a mechanical resonance such that an audio source or vibration source within the timer is effectively amplified for a louder or more pronounced effect that would be achieved without the mechanical resonance.

In one embodiment, an electronic interval timer wherein the timer case comprises a mechanical resonance sufficiently minimal such that an audio source may produce musical tones or speech of quality wherein no mechanical resonant frequency is noticed by an average listener.

In one embodiment, the electronic interval timer of claim 1, wherein: the timer case is waterproof and the timer is free of user-replaceable batteries.

In one embodiment, the electronic interval timer of claim 1, wherein: an OFF face comprises a first background color of black or white and no other face comprises a background of the first background color.

In one embodiment, the electronic interval timer of claim 1, further comprising: a speech output module wherein the speech output module generates a speech message comprising the length of the first initiated time interval when the first time interval is initiated.

One embodiment comprises a kit comprising a timer and one or more user applyable face legends. In one embodiment, at least some of the face legends in the kit correspond to a language or set of face times selectable by an end-user.

One embodiment comprises a kit comprising a timer and an electronic charging base that provides either an electromagnet charging field or a charging light.

Claimed embodiments comprise all combinations of descriptions, features, figures, tables, examples, claims, and claim elements.

DEFINITIONS

Audible sound—may be a beep, ding, alarm sound, music or musical tones, or a sound of arbitrary complexity and length. It may be generated by a wide range of audio sound generators, including speakers, piezoelectric transducers, or electro-mechanical devices such as solenoids; and it may provide a sound from an electronic or data-store-based sound file or data such as a file in mp3, way, or in any other of many well known audio formats, including compressed and proprietary formats. One embodiment of an audible sound is a wireless trigger to a remote sound generator, such as on a smart phone, mobile or wearable electronic device, PC or laptop, or other electronics configured to receive a wireless signal and produce a sound in response. Sounds also include speech and portions of speech.

Audible sound generator—may be a wireless transmission to cause a remote sound generator, such a dedicated receiver, or a smart phone, mobile or wearable electronic device, PC or laptop, or other electronics configured to receive a wireless signal and produce a sound in response to the transmission.

Battery—Singular or plural "battery" or "batteries" words may each refer to either a single battery or plural batteries Clock reference—an oscillator, such as a 32 KHz crystal-based oscillator, resonator, or other clock source, which may be an electronic receiver, for example, receiving WiFi signals or 50 Hz or 60 Hz radio waves, or other electronic input that is used as a reference for the timing functions.

Phrase—a spoken word or set of words that describes an operational state of the timer. Such phrases may or may not be complete, or grammatically correct, sentences.

Polyhedron—ideally regular and symmetric, but it may be distorted or an unusual shape, or have curved or cut corners or edges that do not change its fundamental polyhedron shape, as used herein.

Shake—the normal meaning for a typical user. Consider using a saltshaker or shaking dice as other examples of shaking.

Subset—the L unique face legends are a subset of the N sides of the polyhedron. The subset may be inclusive. That is, L may be equal to N.

Time indicator—a visual time indicator shows a visible number. A pulsing visual indictor is not a time indicator. A steady, pulsing, or flashing light that is on at the completion of a time interval is not a visual time indicator.

Time, Time period or Time interval—the electronic timing module times selected time intervals, such as one minute, 15 minutes, or one hour. Such time intervals have an initiation event that starts the timer for a selected time interval, a run interval equal to the selected time; and an interval expiration (or "completion") wherein, normally, the timer provides an audible or visual indication (or both) that the time interval has expired. A timer interval may terminate prematurely, by being cancelled, or by a new time interval (either shorter or longer) being set. Each time interval has either a normal termination, after the expected time interval has elapsed (or "completed") from the initiation, or an abnormal termination, such as cancellation or superseding by a new time interval. The word, "time," may refer to a time interval.

Top or Up—unless otherwise stated or clear from context, the top of the timer is the OFF face.

User-applyable—capable of being applied, attached or affixed by a user or the device.

Use of the words, "ideal," "ideally," "optimum," "optimum," "should" and "preferred," when used in the context of describing this invention, refer specifically a best mode for one or more embodiments for one or more applications of this invention. Such best modes are non-limiting, and may not be the best mode for all embodiments, applications, or implementation technologies, as one trained in the art will appreciate.

May, Could, Option, Mode, Alternative, Preferred, Implementation and Feature—Use of the words, "may," "could," "option," "optional," "mode," "alternative," "preferred," implementation" and "feature," when used in the context of describing this invention, refer specifically to various embodiments of this invention. All descriptions herein are non-limiting, as one trained in the art will appreciate. Embodiments may be combined to create new embodiments.

What is claimed is:

1. An electronic interval timer comprising a case in the shape of a dodecahedron;

wherein orienting the timer case to a first uppermost face initiates a first time interval corresponding to a first indicia on the first upper most face;

wherein orienting the timer case, prior to expiration of the first time interval, cancels the first time interval and initiates a new time interval corresponding to the sum of: the first time interval corresponding to the first indicia on the first uppermost face added to a second time interval corresponding to a second indicia on a second, now uppermost face.

* * * * *